United States Patent [19]

Halbrook

[11] 4,410,310

[45] Oct. 18, 1983

[54] DEGASSING A CRT WITH MODIFIED RF HEATING OF THE MOUNT ASSEMBLY THEREOF

[75] Inventor: Jack C. Halbrook, Marion, Ind.

[73] Assignee: RCA Corporation, New York, N.Y.

[21] Appl. No.: 256,980

[22] Filed: Apr. 23, 1981

[51] Int. Cl.[3] ..... H01J 9/00; H01J 9/39

[52] U.S. Cl. ..... 445/57; 445/6

[58] Field of Search ..... 316/24, 30, 11, 12, 316/14; 445/57, 3, 6

[56] References Cited

U.S. PATENT DOCUMENTS

| | | | |
|---|---|---|---|
| 2,532,315 | 12/1950 | Johnson et al. | 316/30 |
| 3,115,732 | 12/1963 | Stewart | 53/88 |
| 3,589,791 | 6/1971 | Kanellopoulos | 29/25.11 |
| 3,873,879 | 3/1975 | Hughes | 315/13 |
| 3,922,049 | 11/1975 | Sawicki | 316/19 |
| 4,217,521 | 8/1980 | Dietch et al. | 313/479 |
| 4,234,814 | 11/1980 | Chen et al. | 313/412 |

OTHER PUBLICATIONS

*RCA Technical Notes,* Jun. 1960 Issue, RCA Tn No. 385.

RCA Technical Note No. 1244, "Glow Discharge Processing to Eliminate Afterglow in Color Kinescopes," by Karl G. Hernqvist.

*Primary Examiner*—Kenneth J. Ramsey

*Attorney, Agent, or Firm*—E. M. Whitacre; D. H. Irlbeck; L. Greenspan

[57] ABSTRACT

While a CRT is being baked at temperatures up to about 450° C. and exhausted of gases prior to sealing, the mount assembly is heated to higher temperatures with RF energy. In the novel method, a selected portion of the mount assembly is shielded from the RF energy in such manner that it is not heated above about 350° C.

7 Claims, 2 Drawing Figures

DEGASSING A CRT WITH MODIFIED RF HEATING OF THE MOUNT ASSEMBLY THEREOF

BACKGROUND OF THE INVENTION

This invention relates to a novel method of degassing a CRT (cathode-ray tube) with modified RF (radio frequency) heating of the mount assembly thereof during the simultaneous baking and exhausting of the CRT.

A CRT comprises an envelope which includes a neck, a funnel and a faceplate. A viewing screen and various coatings are applied to internal surfaces of the envelope. A mount assembly, supported from a glass stem and including an electron gun or guns, is sealed into the neck of the envelope. After the mount assembly is sealed into the neck, the CRT, which is open to the atmosphere through a glass tubulation connected to the stem, is baked at about 300° to 450° C. and is simultaneously exhausted to a relatively low pressure through the glass tubulation. During this baking, the temperature of the mount assembly rises to about 250° to 300° C. Then, the CRT is tipped off; that is, the tubulation is sealed. Near the end of the baking cycle and prior to tipping off, RF energy at about 1.0 to 1.5 megahertz is applied to degas metal structures, particularly the electrodes of the mount assembly. The RF energy heats the metal structures to temperatures above 450° C., usually about 600° to 750° C., in order to drive out occluded and adsorbed gases.

A completed CRT, installed in a chassis, and operated in a normal manner, may continue to emit light from the viewing screen after the normal operating voltages are removed from the mount assembly. This effect, which may linger for minutes or hours, is referred to as afterglow and is attributed to the coincidence of two factors. First, a large residual electrostatic charge remains on the filter capacitor (which is integral with the CRT) after the operating voltages are removed, and therefore a residual high voltage remains on the anode of the CRT with respect to the other electrodes of the mount assembly. Second, there are sites on the electrodes of the electron gun from which electrons can be emitted when they are under the influence of the electric field produced by the residual charge on the filter capacitor. Emitted electrons under the influence of the electric field are directed toward and impinged upon the viewing screen producing the afterglow.

SUMMARY OF THE INVENTION

In the novel method, the number and efficiency of field-emission sites are substantially reduced so that there is substantially less field emission, and little or no afterglow is observed. The novel method follows the prior method of baking, exhausting, RF heating and tipping off except that, during the RF-heating step, at least a portion of the mount assembly is selectively shielded from the RF energy in such manner as to prevent that portion from being heated above about 350° C. In a preferred embodiment, the shielded portion of the mount assembly is the portion of an electrode that faces another electrode that is to carry the anode voltage. Where two electrodes are to carry the anode voltage, the electrodes facing one or both of these anode-voltage-carrying electrodes can be shielded.

DETAILED DESCRIPTION OF THE PREFERRED EMBODIMENTS

A preferred embodiment of the novel method may be practiced in a continuous apparatus, such as that disclosed in U.S. Pat. No. 3,922,049 issued Nov. 25, 1975 to F. S. Sawicki, for example. The apparatus comprises a train of exhaust carts moving around a closed elongated loop. A tunnel oven of generally U-shaped plan is located over a portion of the train of carts in a manner to enclose the faceplates and funnels of the CRTs being processed. The tunnel is divided into zones which are heated to prescribed temperatures such that the faceplate and funnel of each CRT moving through the tunnel experience a desired heating profile. Near the exit end of the tunnel, RF energy is applied to the neck of the CRT, which is outside the tunnel, as described below.

Figure 1:
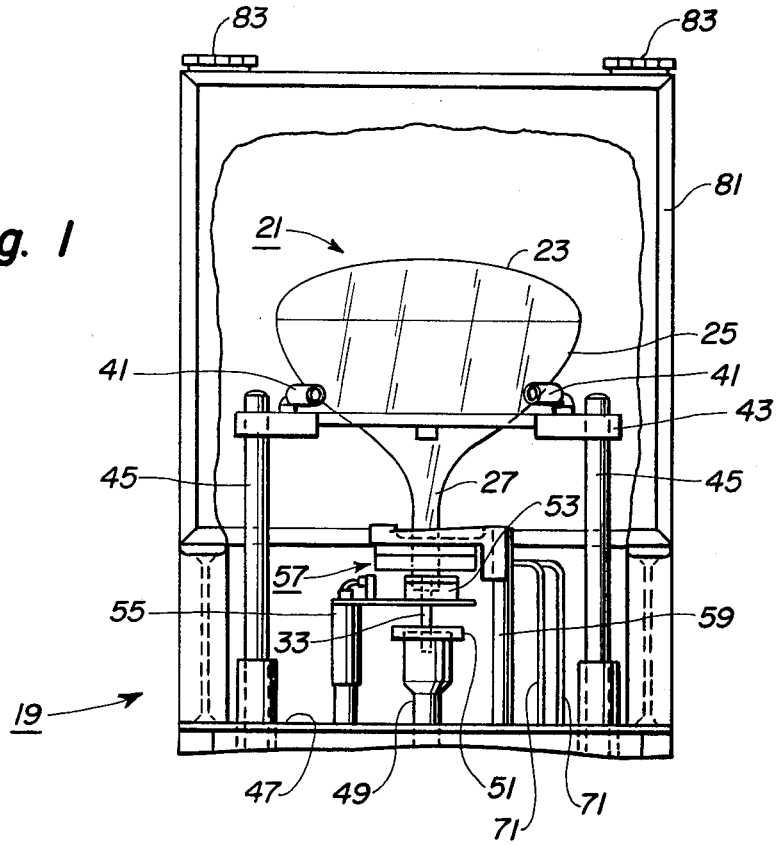
FIG. 1 is a broken-away, elevational view of a portion of an exhaust part modified for practicing the novel method.
Figure 2:
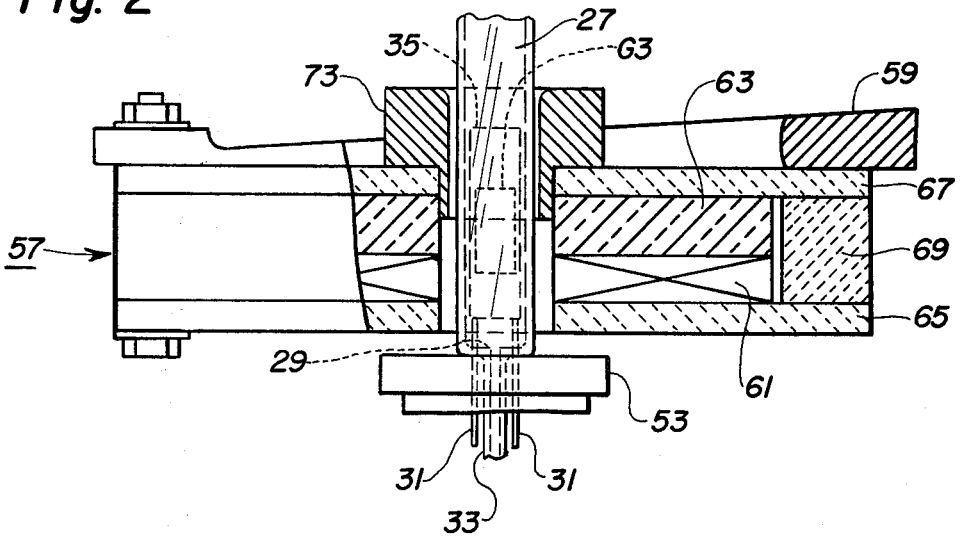
FIG. 2 is an enlarged view of the RF coil and RF shield of the part shown in FIG. 1.

As shown in FIGS. 1 and 2, each exhaust cart 19 carries one CRT 21. Each CRT 21 comprises an envelope including a faceplate 23 sealed to a funnel 25 having an integral glass neck 27. The neck 27 is closed at one end by a glass stem 29 (FIG. 2), which has metal stem leads 31 and a glass tubulation 33 extending outwardly therefrom. The stem leads 31 also extend inwardly and support a mount assembly 35 (FIG. 2) of the CRT. The mount assembly 35 includes three electron guns, each of which comprises an indirectly-heated cathode and several sequentially-spaced electrodes including a focusing electrode G3 (FIG. 2).

The mount assembly 35 may be of any of the designs which may be used in a CRT. Some such mount assemblies are described in detail in U.S. Pat. Nos. 4,234,814 issued Nov. 18, 1980 to H-Y Chen et al and 3,873,879 issued Mar. 25, 1975 to R. H. Hughes.

The CRT 21 is supported in an exhaust cart 19 that is similar in design to the exhaust cart described in U.S. Pat. No. 3,115,732 issued Dec. 31, 1963 to J. F. Stewart. The CRT is supported in the cart 19, part of which is shown in FIG. 1, on cradle arms 41, which are supported from a cradle frame 43 which is mounted on two support posts 45 attached to a platform 47. The cart 19 includes an exhausting means (not shown) that is connected to a compression head 49 which extends through an opening in the platform 47. The upper end of the compression head 49 is provided with an exhaust port assembly 51 into which the tubulation 33 is received in a temporary vacuum-tight relationship. An electric radiant tipoff heater 53 is supported from the platform 47 by a tipoff heater post-and-arm 55. The radiant heater 53 encircles the tubulation 33 adjacent the stem 29 and is operable to soften and close the tubulation 33 and thereby tip off and seal the CRT after the exhausting step is completed. An RF heater coil assembly 57 is supported from the platform 47 by an RF heater post-and-arm 59. The RF heater coil assembly 57 is toroidal in shape, having a central aperture into which the neck 27 of the CRT 21 can be positioned. The assembly 57 comprises a toroidal-shaped coil 61 and a matching toroidal-shaped magnetic ferrite piece 63 on top of the coil 61 in an electrically-insulating, heat-resistant container made, for example, of Transite, an asbestos-cement product of Johns-Manville Corporation, Denver, Colo. As shown in FIG. 2, the container comprises a lower plate 65, an upper plate 67 and a spacer ring 69. The assembly 57 includes a cooling coil (not shown) supplied with circulating cooling water through pipes 71. The RF heater coil 61 is adapted to be energized near the end of the heating cycle and to induce RF energy into metal parts of the mount assembly 35.

In the novel method, it is necessary to shield a selected portion of the mount assembly from the RF energy so ,that the temperature thereof does not rise above about 350° C. As shown in FIG. 2, the upper end of the G3 electrode is shielded by a snubber ring 73 which is about 76 mm (3.0 inches) outer diameter and has a central aperture about 34 mm (1.25 inches) inner diameter and large enough to fit loosely around the neck 27 of the CRT 21. A short circular extension fits into the central aperture of the upper plate 67. The snubber ring 73 is made of metal, preferably soft copper, although it could be made from other metals, such as aluminum, or of alloys of metals, such as brass. The shape and the size of the snubber ring 73 are optimized for each design of CRT so that the desired shielding is obtained.

The above-described equipments are operated in their usual manner. Each cart has a safety cage over the platform 47 with a cage door 81 that opens around hinges 83. The cage door 81 is opened, and a CRT 21 is loaded onto the the cradle arms 41 of the cart through the open cage door 81 of the cart 19. The height of the CRT above the platform is adjusted, and the exhaust port assembly 51 is temporarily sealed to the tubulation 33. Then, the cage door 81 is closed, and the cart 19 is passed through the tunnel oven (not shown) where the faceplate 23 and funnel 25 are heated to temperatures in the range of about 300° to 450° C. During this heating cycle, the neck 27 and mount assembly 35 heat up to temperatures in the range of about 250° to 300° C. During the heating cycle, the inside of the CRT is continuously exhausted through the tubulation 33. Near the end of the heating cycle, the RF coil 61 is excited with RF energy of about 1.2 kilohertz for about 5 minutes. This induces eddy currents in the metal parts of the mount assembly 35 except for those portions which are shielded by the snubber ring 73. The eddy currents heat the metal parts to temperatures in the range of about 600° to 750° C., whereas the temperatures of the shielded parts do not rise above about 350° C. After completion of the RF excitation, the tipoff heater 53 is activated to heat a small area of the tubulation 33 to soften the glass, which, due to atmospheric pressure, collapses and seals to itself thereby sealing the interior of the CRT 21 from the atmosphere. The CRT 21 is permitted to cool, and the excess tubulation 33 is cracked off. Then, the cage door 81 is opened, and the CRT is disengaged and removed from the cart.

In this example, the RF shielding is used to prevent the upper portion of the G3 electrode from being heated above about 350° C. This procedure (shielding a portion of the G3 from RF energy during exhausting) has been found to produce a drastically lower percentage of CRTs that exhibit afterglow. The reasons for this are not completely understood. The procedure produces a significantly lower temperature on portions of the mount assembly that are believed to have sites for field emission, while permitting the remainder of the mount assembly to be heated to temperatures that drive out undesirable gas ions. At the same time, the cathode is protected from adverse effects of outgassing. It is believed that the lower temperatures in the areas shielded from the RF energy produce a lower density of field-emission sites in the very area where the high voltage produced by residual charge on the filter capacitor has its greatest influence. During the initial tests of the novel method, over 5,000 tubes were produced using the snubber ring, and a comparable number of tubes were produced with no snubber rings being used. The following table illustrates the beneficial effect of the novel method:

| Defect Description | Percentage No Snubber | Percentage Using Snubber |
|---|---|---|
| Afterglow | 30 to 32 | 4 |
| Emission, gross | 12 | 3 |
| Emission, net | 1.75 | 0.3 |

I claim:

1. In a method for making a cathode-ray tube comprising an envelope and a mount assembly including a plurality of sequentially-spaced electrodes sealed in said envelope, said method including baking said envelope whereby said mount assembly is heated to about 250° to 300° C., simultaneously exhausting gases from said envelope and applying radio-frequency energy to said mount assembly during said heating step to heat conductive parts thereof above about 450° C., the improvement comprising selectively shielding at least a portion of one of said electrodes from said radio-frequency energy in such manner as to prevent said portion from being heated bove about 350° C., said portion being part of an electrode that faces another electrode that is to carry the anode voltage of said tube.

2. The method defined in claim 1 wherein said radio frequency energy is applied by induction from a toroidal coil around said mount assembly.

3. The method defined in claim 2 wherein said shielding is achieved by interposing a metal ring around at lest part of said portion of said one of said electrodes.

4. In a method for making a cathode-ray tube comprising an envelope and a mount assembly sealed in said envelope, said mount assembly including a cathode and a plurality of electrodes sequentially spaced from said cathode, said electrodes including an anode electrode most remotely spaced from said cathode for carrying the highest positive voltage on said mount assembly, and a grid electrode adjacent said anode electrode, said method including the steps of baking said envelope at about 300° to 450° C. whereby the temperature of said mount assembly rises to about 250° to 300° C., simultaneously exhausting gases from said envelope, applying radio-frequency energy to said mount assembly during a portion of said heating step to heat metal parts of said mount assembly above 450° C., and then sealing said envelope, the improvement comprising selectively shielding the portion of said grid electrode that faces said anode electrode from said radio-frequency energy in such manner as to prevent said portion from being heated above about 350° C.

5. The method defined in claim 4 wherein said envelope includes a neck, and said mount assembly is housed in said neck.

6. The method defined in claim 5 wherein said radio frequency energy is applied by induction from a toroidal coil around said neck and said mount assembly, and said shielding is achieved by a metal ring in a selected position around said neck.

7. The method defined in claim 6 wherein said metal ring consists essentially of copper metal.

* * * * *